US010370868B2

(12) United States Patent
Komkin

(10) Patent No.: US 10,370,868 B2
(45) Date of Patent: Aug. 6, 2019

(54) LOCK CYLINDER WITH PLATE TUMBLERS FOR A CYLINDER LOCK, AS WELL AS A CYLINDER LOCK HAVING A LOCK CYLINDER OF THIS TYPE

(71) Applicant: D. La Porte Sohne GmbH, Wuppertal (DE)

(72) Inventor: Viktor Komkin, Wuppertal (DE)

(73) Assignee: D. La Porte Sohne GmbH, Wuppertal (DE)

( * ) Notice: Subject to any disclaimer, the term of this patent is extended or adjusted under 35 U.S.C. 154(b) by 498 days.

(21) Appl. No.: 14/990,082

(22) Filed: Jan. 7, 2016

(65) Prior Publication Data

US 2016/0194902 A1 Jul. 7, 2016

(30) Foreign Application Priority Data

Jan. 7, 2015 (DE) ..... 10 2015 000 213

(51) Int. Cl.
*E05B 29/00* (2006.01)
*E05B 15/04* (2006.01)

(52) U.S. Cl.
CPC ..... *E05B 29/0033* (2013.01); *E05B 15/04* (2013.01); *E05B 29/00* (2013.01)

(58) Field of Classification Search
CPC ..... E05B 29/0033; E05B 29/00; E05B 15/04
USPC ..... 70/492, 375, 377
See application file for complete search history.

(56) References Cited

U.S. PATENT DOCUMENTS 1,657,039 A 4/1928 Schafer
1,964,963 A 7/1934 Shinn
2,047,966 A * 7/1936 Jacobi ..... E05B 29/00 70/367

(Continued)

FOREIGN PATENT DOCUMENTS

CN 201535096 U 7/2010
DE 2703537 A1 8/1978

(Continued)

OTHER PUBLICATIONS

German language Wikipedia entries, and translations, for the term "Leiste," which is "bar", Oct. 13, 2015.

(Continued)

*Primary Examiner* — Suzanne L Barrett
(74) *Attorney, Agent, or Firm* — Eric J. Sosenko; Jonathan P. O'Brien; Honigman LLP

(57) ABSTRACT

A lock cylinder, for a cylinder lock, having a cylinder housing with a core receiving cut-out and axially extending blocking grooves open to the core receiving cut-out. The lock cylinder having a cylinder core supported inside the core receiving cut-out and having a plurality of guide slots extending through the core. Plate tumblers supported in the guide slots such that they can be displaced back and forth in the plate sliding direction between a locking position, in which the cylinder core is connected to the cylinder housing in a non-rotating manner about a cylinder axis, and a non-locking position, in which they are driven into the cylinder core and the cylinder core can rotate about the cylinder axis. Wherein two plate tumblers are connected to a single spring so as to be driven in opposite directions into their respective locking positions.

28 Claims, 9 Drawing Sheets

(56) References Cited

U.S. PATENT DOCUMENTS

| | | | | | |
|---|---|---|---|---|---|
| 2,079,628 | A * | 5/1937 | Olson | E05B 29/00 | 70/358 |
| 2,123,940 | A * | 7/1938 | Gray | E05B 29/00 | 70/375 |
| 2,248,475 | A * | 7/1941 | Hamilton | E05B 29/00 | 70/447 |
| 2,375,682 | A * | 5/1945 | Olson | E05B 29/00 | 70/419 |
| 2,453,066 | A | 11/1948 | Gabrielsen | | |
| 2,895,323 | A * | 7/1959 | Kennedy | E05B 29/004 | 70/376 |
| 3,735,614 | A * | 5/1973 | Keller-Volper | E05B 29/00 | 70/377 |
| 3,969,915 | A * | 7/1976 | Droske | E05B 29/00 | 70/377 |
| 4,682,484 | A | 7/1987 | Yeh | | |
| 5,174,141 | A * | 12/1992 | Ohyabu | E05B 29/00 | 70/377 |
| 7,360,382 | B2 * | 4/2008 | Fernandez | E05B 29/00 | 70/350 |
| 8,276,419 | B2 * | 10/2012 | Farrenkothen | E05B 29/00 | 70/377 |
| 8,695,390 | B2 * | 4/2014 | Ng | E05B 29/00 | 70/419 |
| 2006/0225471 | A1 * | 10/2006 | Fernandez | E05B 29/00 | 70/427 |
| 2009/0188286 | A1 * | 7/2009 | Farrenkothen | E05B 29/00 | 70/351 |

FOREIGN PATENT DOCUMENTS

| | | |
|---|---|---|
| EP | 2083136 A2 | 7/2009 |
| FR | 501819 | 7/1919 |
| FR | 1296552 | 11/1960 |
| GB | 147881 | 5/1921 |
| JP | 2008196131 A | 8/2008 |

OTHER PUBLICATIONS

German language Wikipedia entries, and translations, for the term "Feder", which is "spring", Oct. 14, 2015.

* cited by examiner

LOCK CYLINDER WITH PLATE TUMBLERS FOR A CYLINDER LOCK, AS WELL AS A CYLINDER LOCK HAVING A LOCK CYLINDER OF THIS TYPE

TECHNICAL FIELD

The present invention relates to a lock cylinder with plate tumblers for a cylinder lock, in particular for motor vehicles, preferably agricultural or construction machines, as well as a cylinder lock with a lock cylinder of this type and a key fitting thereto.

BACKGROUND

EP 2 083 136 A2 discloses a lock cylinder, having a cylinder housing in which a cylinder core is rotatably supported about a cylinder axis. The cylinder core has a key channel extending axially and guide slots extending perpendicular thereto, which pass through the cylinder core. The guide slots are disposed adjacent to one another in the axial direction. Two rectangular frame shaped plate tumblers are disposed in each guide slot. The plate tumblers engage in their locked position when the key has been withdrawn due to the spring load formed in each case by a compression spring in blocking grooves of the cylinder housing, such that the cylinder core sits non-rotatably in the cylinder housing. The rectangular plate tumblers each have a counter bearing lug, on which the compression spring is supported and by means of which the movement of the plate tumblers is limited in the direction of locking. The counter bearing lug and the compression spring are guided in a circular cylindrical channel of the cylinder core that opens into the environment.

The rectangular frame-shaped plate tumblers in EP 2 083 136 A2 also have a central key receiving opening for receiving a key. Control steps are provided in the key receiving openings that extend into the key channel for interacting with control tracks of a reversible key fitting thereto.

A lock cylinder of the same type, having a cylinder housing and cylinder core, is likewise known from DE 2703537 A1. The cylinder core has a key channel that extends axially and a pair of guide slots that extend perpendicular thereto, passing through the cylinder core. The pair of guide slots are disposed adjacent to one another in the axial direction. A pair of guide slots is obtained thereby composed of two guide slots spaced apart from one another in a direction perpendicular to the cylinder axis. An oblong plate tumbler is disposed in each guide slot. The oblong plate tumblers each have a key receiving groove for receiving a key, wherein the edges of the groove serve as control steps for interacting with control tracks of a key that fits thereto. Furthermore, the known plate tumblers likewise each comprise a counter bearing lug for supporting the respective compression spring and for limiting the movement of the plate tumblers in the direction of locking.

High demands are placed on cylinder locks of this type. They must have as many key combinations as possible, among other things, in order to ensure the greatest possible security (ECE-regulation No. 116-5.2.6). Furthermore, they must be constructed such that a rotation of the lock cylinder when in the locked setting with a torque of less than 2.45 Nm is only possible with the key fitting thereto (ECE-regulation No. 116-5.2.10).

With the known rectangular frame-shaped plate tumblers there is the problem that these tumblers will become deformed when subjected to anything more than a slight torque. This occurs, on one hand, due to the rectangular shape. Depending on the direction of rotation, a support of the plate tumblers in the cylinder core occurs, additionally, via the counter bearing lug. This likewise leads to torsion of plate tumblers. The channel in which the compression spring is located is also significantly wider than the thickness of the plates, or the height of the plate tumblers, respectively. For this reason, the plate tumblers are not supported via their entire plate thickness on the cylinder core when two are disposed in a guide slot, but rather, they are supported on a small projection of the cylinder core. This is likewise sheared off when subjected to an excessive load.

With the known oblong plate tumblers as well, there is the problem that these tumblers bend easily, particularly when the direction of rotation is such that the support of the cylinder core occurs via the counter bearing lug.

SUMMARY

In one aspect, the present invention provides a lock cylinder with plate tumblers for a cylinder lock for motor vehicles, in particular of agriculture and construction machines, that ensures a high number of key combinations and withstands higher torques. The lock cylinder is able to be produced inexpensively and has a simple construction.

In another aspect, the invention provides a cylinder lock for a motor vehicle, in particular for agriculture and construction machines, having a lock cylinder of this type and a key fitting thereto.

DETAILED DESCRIPTION

Figure 1:
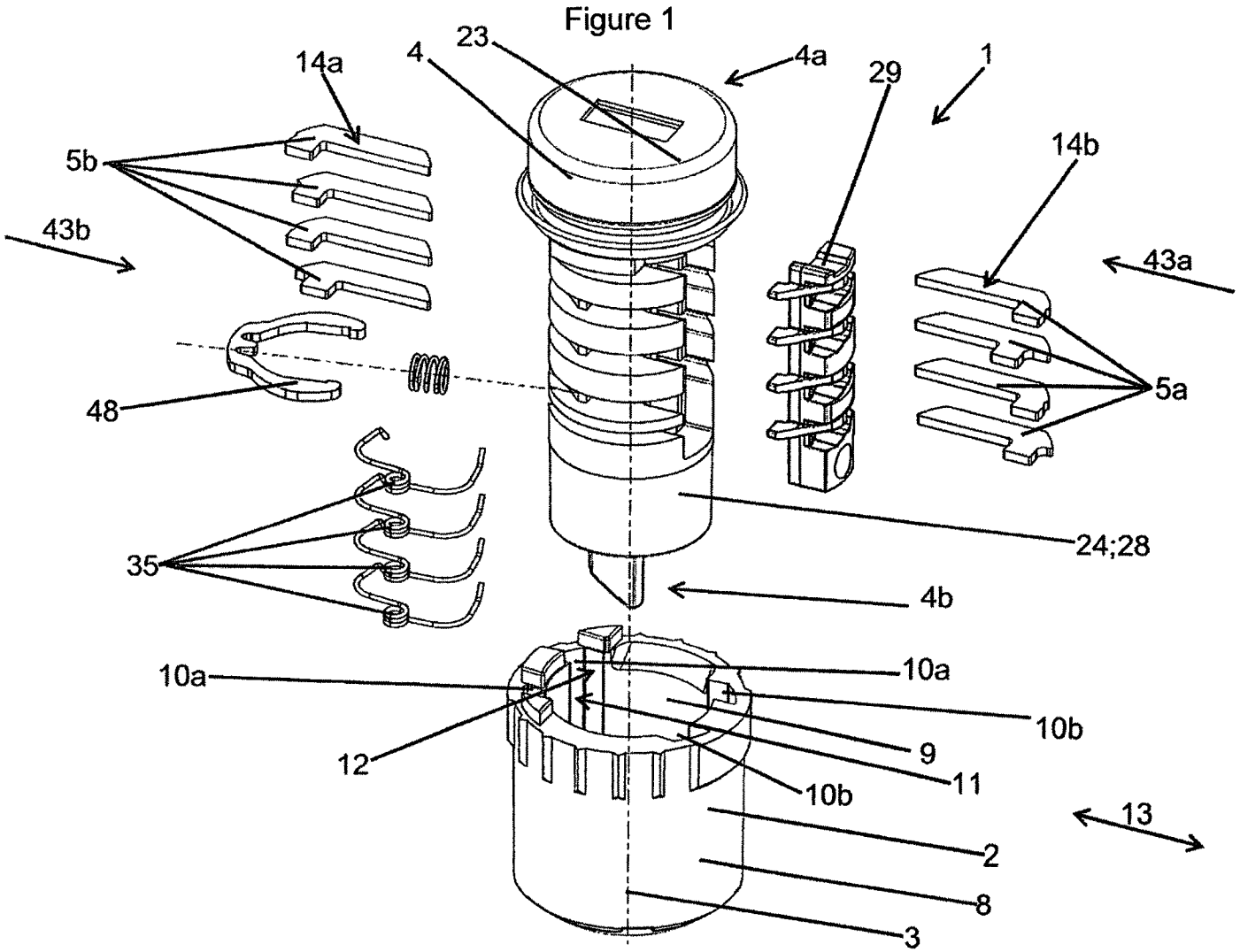
FIG. 1 is a perspective exploded depiction of a lock cylinder embodying the principles of the present invention.
Figure 2:
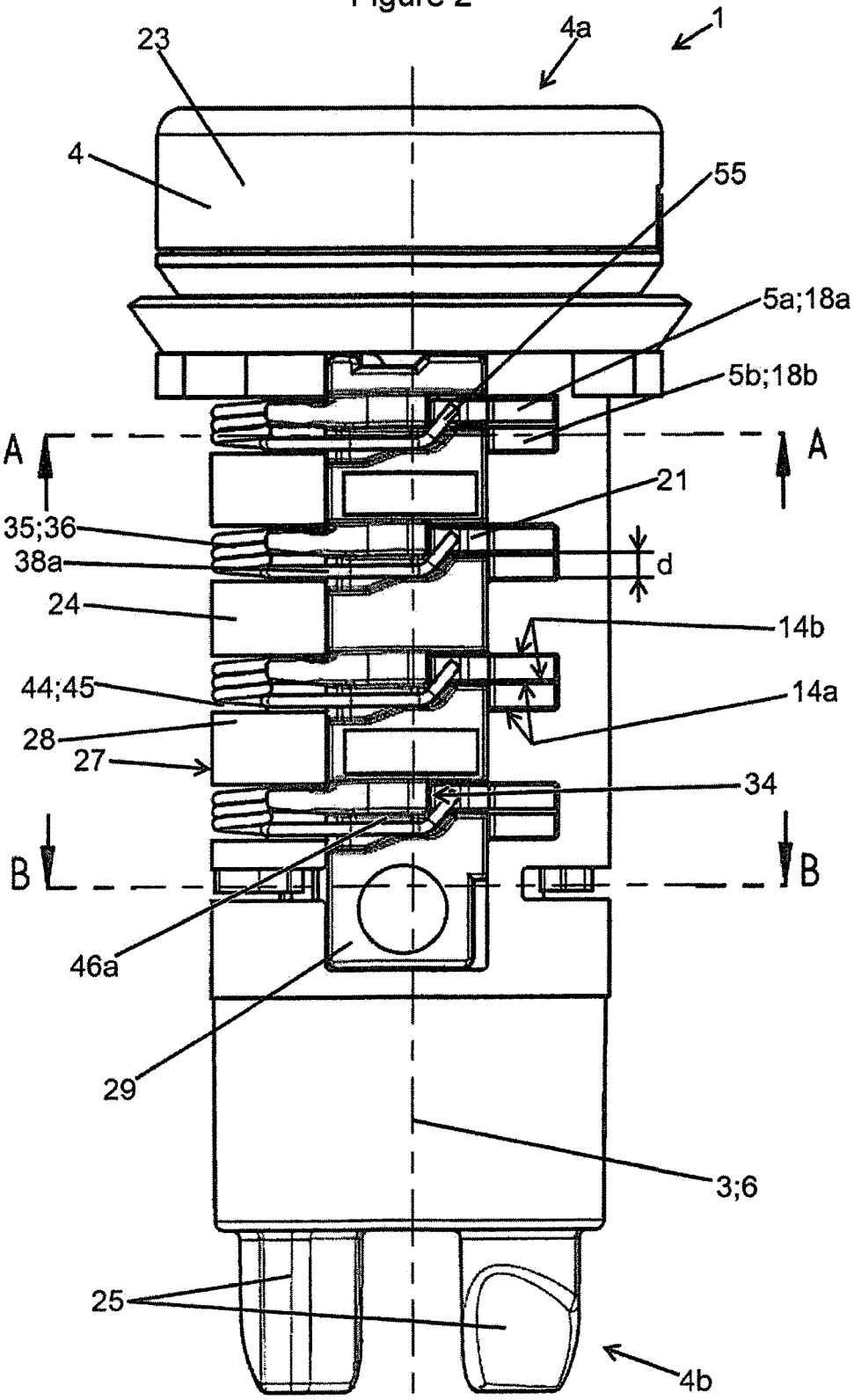
FIG. 2 is a first side view of the lock cylinder, without a cylinder housing, plate tumblers in the locking position.
Figure 3:
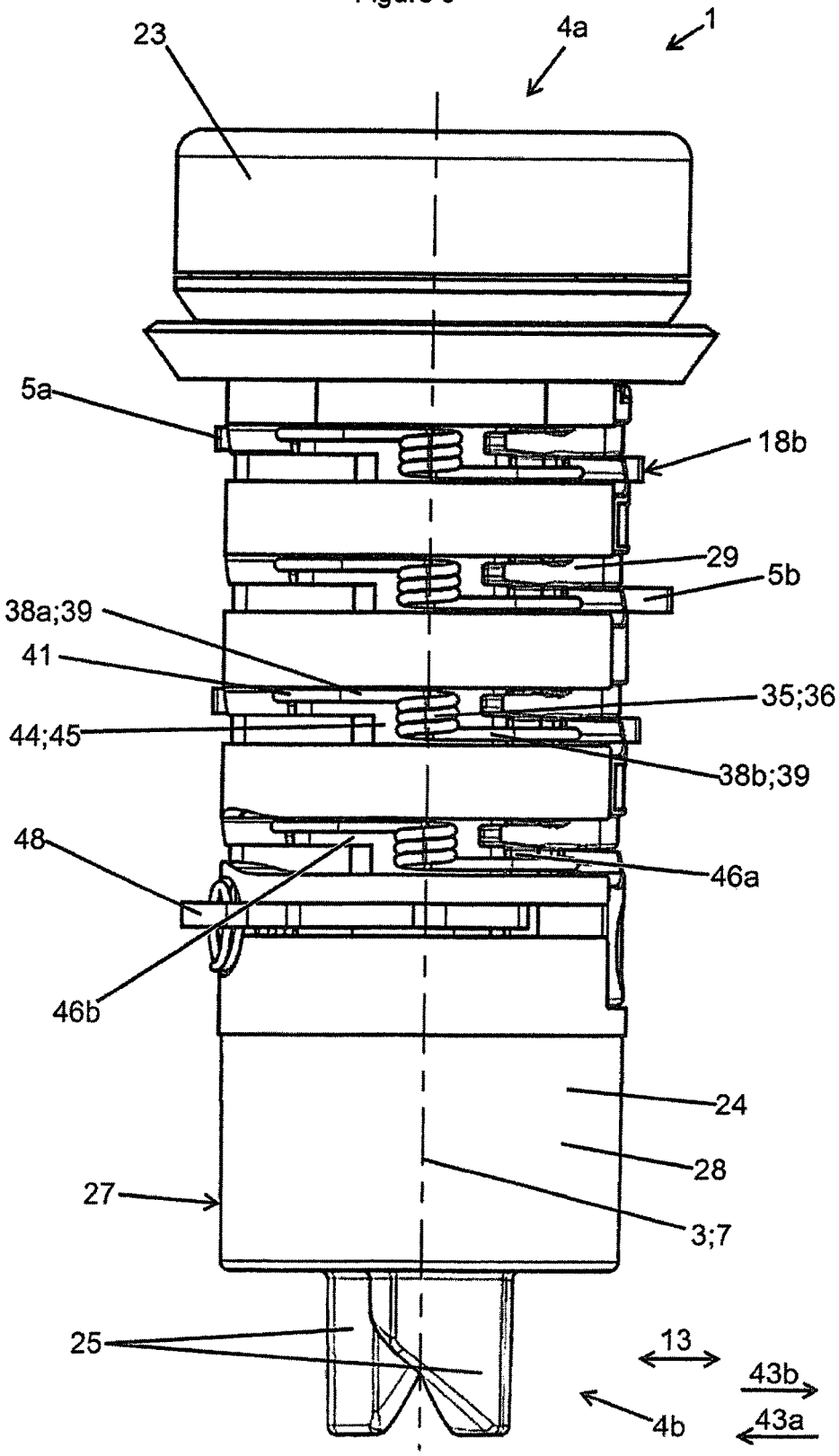
FIG. 3 is a further side view of the lock cylinder, without a cylinder housing, plate tumblers in the locking position.
Figure 4:
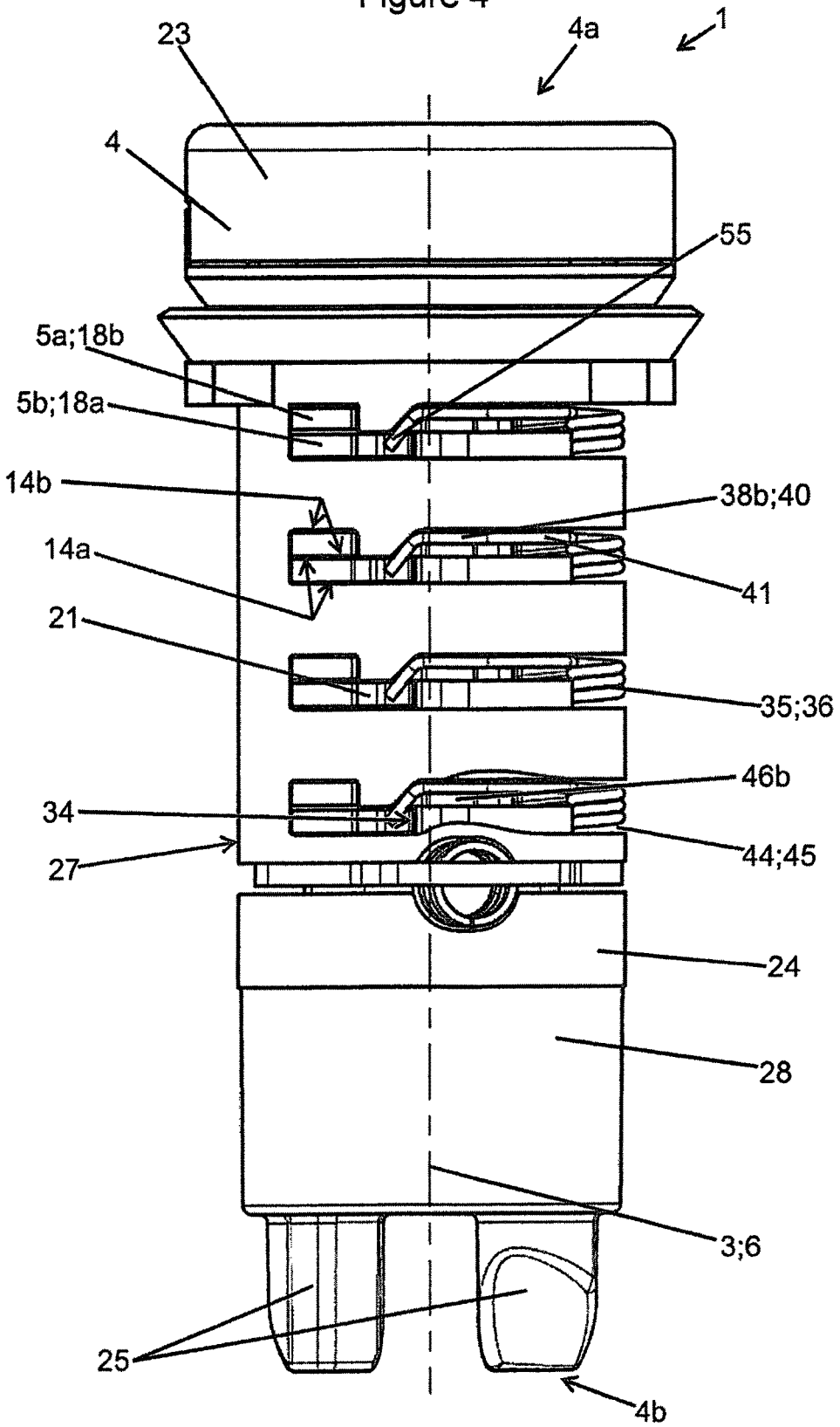
FIG. 4 is a further side view of the cylinder lock, without a cylinder housing, plate tumblers in the locking position.
Figure 5:
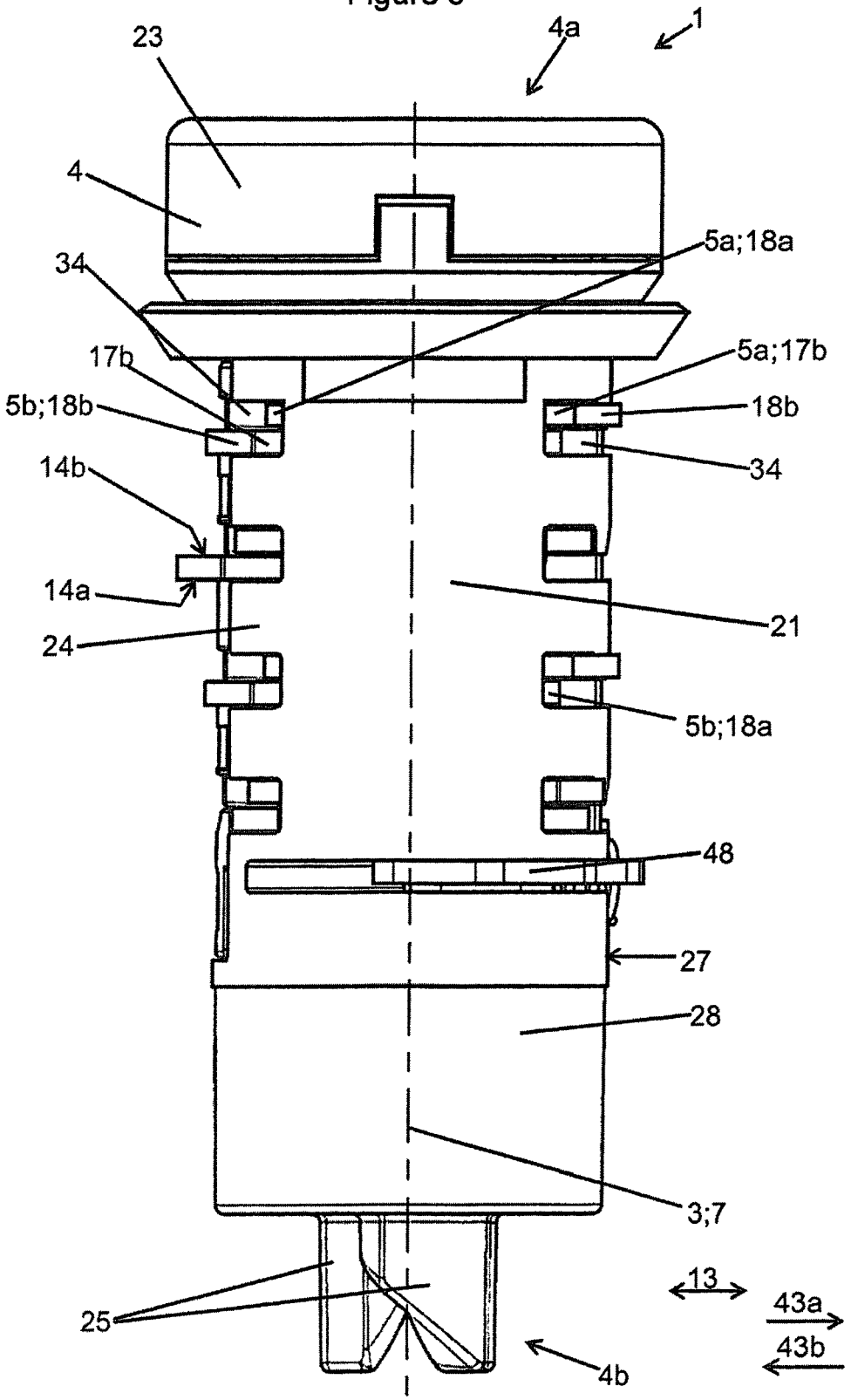
FIG. 5 is a further side view of the lock cylinder, without a cylinder housing, plate tumblers in the locking position.
Figure 6:
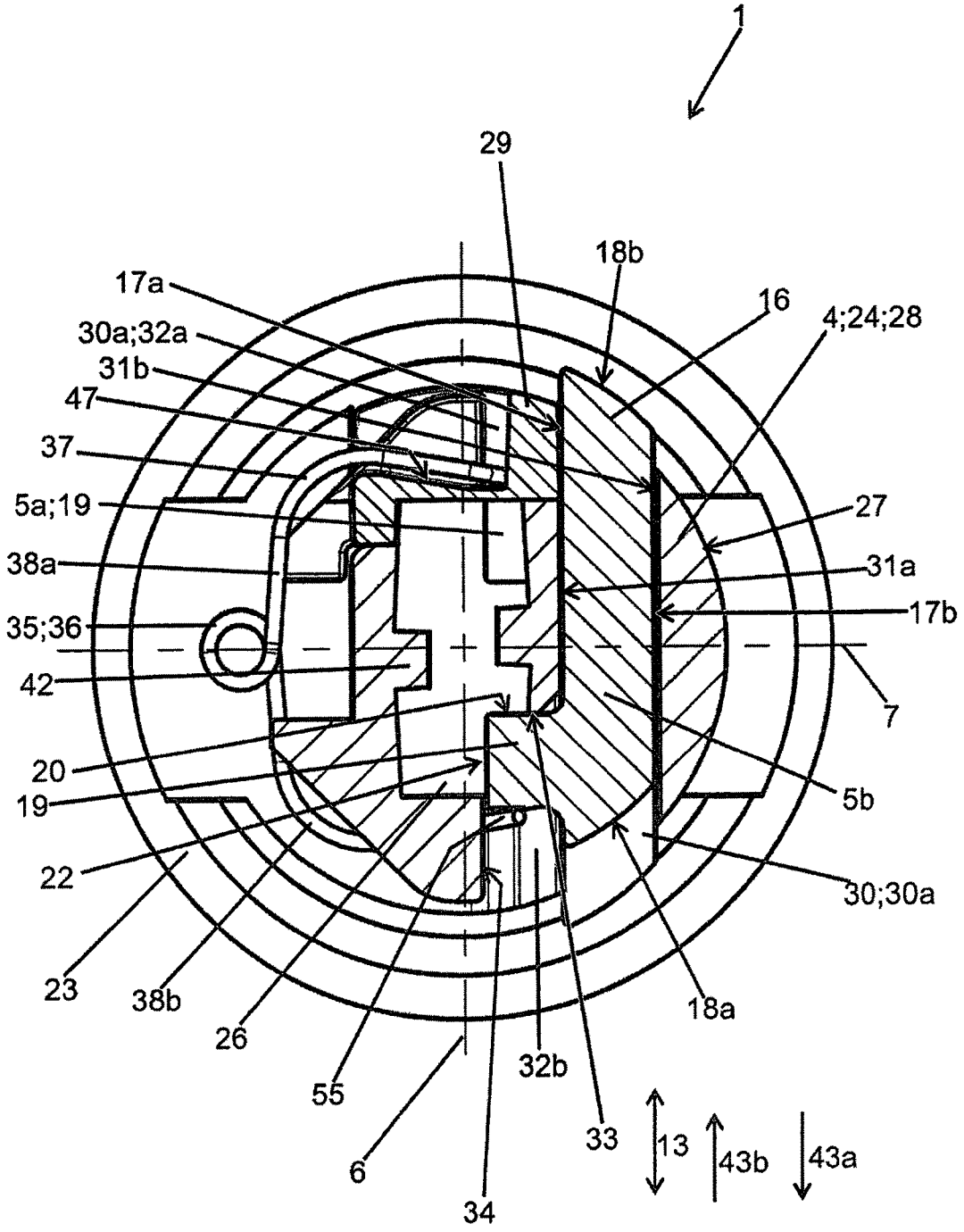
FIG. 6 is a section view generally along the line A-A in FIG. 2, with the plate tumblers in their locking initial position.
Figure 7:
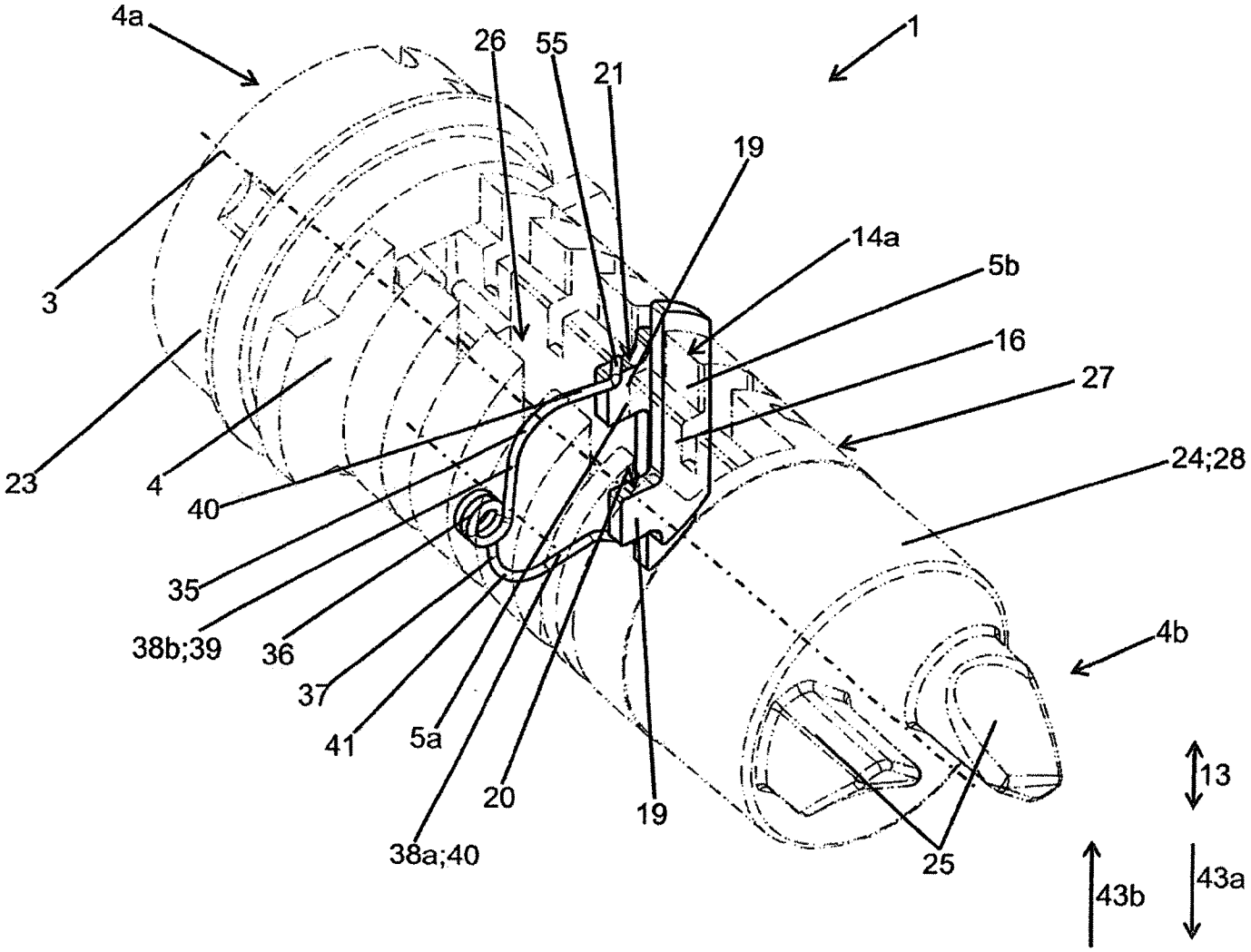
FIG. 7 is a perspective view of the lock cylinder, without a cylinder housing, with a cylinder core depicted by a broken line, and without an inset component.
Figure 8:
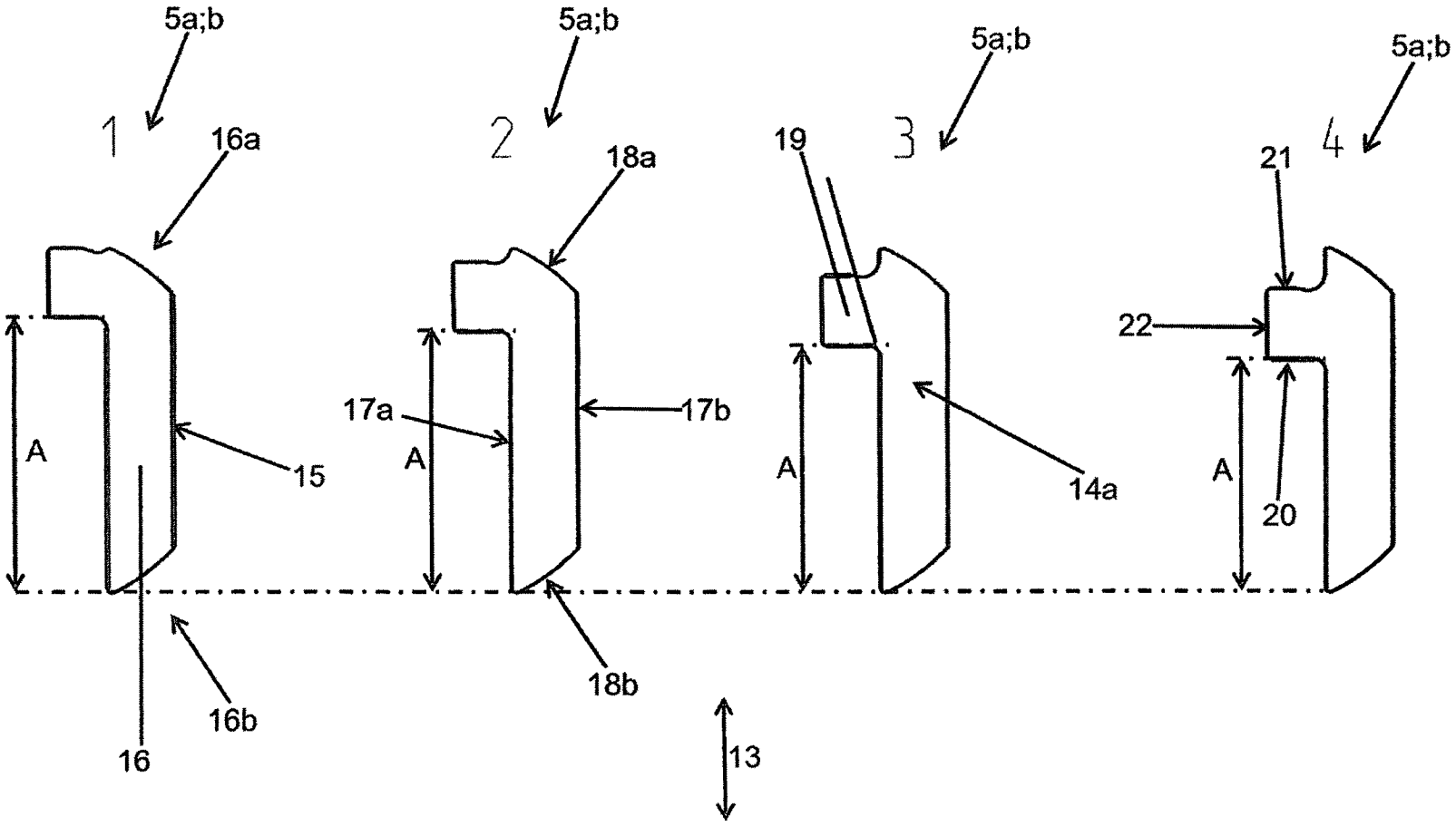
FIG. 8 is a view from above, of numerous plate tumblers having different arrangements of a control and counter bearing lug.

A lock cylinder 1 embodying the principles of the present the invention (FIGS. 1 to 7) has a cylinder housing 2, a cylinder axis 3, a cylinder core 4, and numerous plate tumblers 5*a*; 5*b*. Furthermore, the lock cylinder 1 has a longitudinal central plane, or a first longitudinal central plane 6, respectively, containing the cylinder axis, and a transverse central plane, or second longitudinal central plane 7, respectively, perpendicular thereto and likewise containing the cylinder axis 3.

The cylinder housing 2 (FIG. 1) is designed as a hollow cylinder and has a housing wall 8 as well as a core receiving cut-out 9 that extends through the housing wall 8 and has a circular cylindrical shape. The housing wall 8 thus surrounds the core receiving cut-out 9. The cylinder housing 2 furthermore has four blocking grooves 10*a*; 10*b* for receiving the plate tumblers 5*a*; 5*b* in their locking position, or in the lock position, respectively. In addition, the blocking grooves 10*a*; 10*b* extend from the core receiving cut-out 9 into the housing wall 8. The blocking grooves 10*a*; 10*b* each have a groove floor surface 11 and two groove lateral surfaces 12.

Two blocking grooves 10*a*; 10*b* lie in each case opposite one another in a plate sliding direction 13, parallel to the longitudinal central plane 6 and perpendicular to the cylinder axis 3. The blocking grooves 10*a*; 10*b* lying opposite one another in the sliding direction 13 of the plates are furthermore disposed symmetrically in relation to the transverse central plane 7.

The four blocking grooves 10*a*; 10*b* are furthermore, disposed symmetrically in relation to the longitudinal central plane 6 and to the transverse central plane 7. The presence of four blocking grooves 10*a*; 10*b* makes it possible for a key 50 (FIGS. 9 and 10) fitting thereto to be withdrawn after it has been rotated 180°, if this is desired. However, for the purposes of the invention, two blocking grooves 10*a*; 10*b* lying opposite one another in the plate sliding direction 13 are sufficient. In particular, two blocking grooves 10*a*; 10*b* lying opposite one another in the plate sliding direction 13 are then sufficient if a pulse circuit is present.

The oblong, or strip-shaped plate tumblers 5*a*; 5*b* (FIGS. 1-8) have two planar tumbler surfaces 14*a*; 14*b* lying opposite one another, as well as an encompassing plate edge 15. The two plate surfaces 14*a*; 14*b* are perpendicular to the cylinder axis 3 when the plate tumblers 5*a*; 5*b* are in the installed state. The plate tumblers 5*a*; 5*b* also have a longitudinal guide and blocking strip 16, having a longitudinal extension parallel to the plate sliding direction 13. The guide and blocking strip 16 has a first strip blocking end 16*a* and a second strip blocking end 16*b*, wherein the two strip ends 16*a*; 16*b* lie opposite one another in the direction of the plate sliding direction 13. The guide and blocking strip 16 also has a first strip longitudinal edge, or a strip sliding edge 17*a*, respectively, a second strip longitudinal edge, or strip sliding edge 17*b* respectively, and two strip end edges 18*a*; 18*b*. The two strip sliding edges 17*a*; 17*b* each extend parallel to the plate sliding direction 13 and from the first strip blocking end 16*a* to the second strip blocking end 16*b*. The second strip sliding edge 17*b* extends continuously, thus without interruption, from the one to the other strip edge 18*a*; 18*b*. The two strip end edges 18*a*; 18*b* connect the two strip sliding edges 17*a*; 17*b* to one another, respectively, and preferably extend at a diagonal to the plate sliding direction 13.

In accordance with the invention, the plate tumblers 5*a*; 5*b* also each have a control and counter bearing projection, or a control and counter bearing lug 19, which adjoins the first strip sliding edge 17*a* and protrudes away from it. The plate-shaped control and counter bearing lug 19 is disposed adjacent to the first strip blocking end 16*a* thereby. This means that it is disposed closer to the first strip blocking end 16*a* than to the second strip blocking end 16*b*.

The control and counter bearing lug 19 has a control and counter bearing edge 20, a spring support edge 21 and a lug-end edge 22. The control and counter bearing edge 20 as well as the spring support edge 21 adjoin the first strip sliding edge 17*a* thereby, and extend away therefrom. The lug end-edge 22 connects the control and counter bearing edge 20 and the spring support edge 21 to one another.

Figure 9:
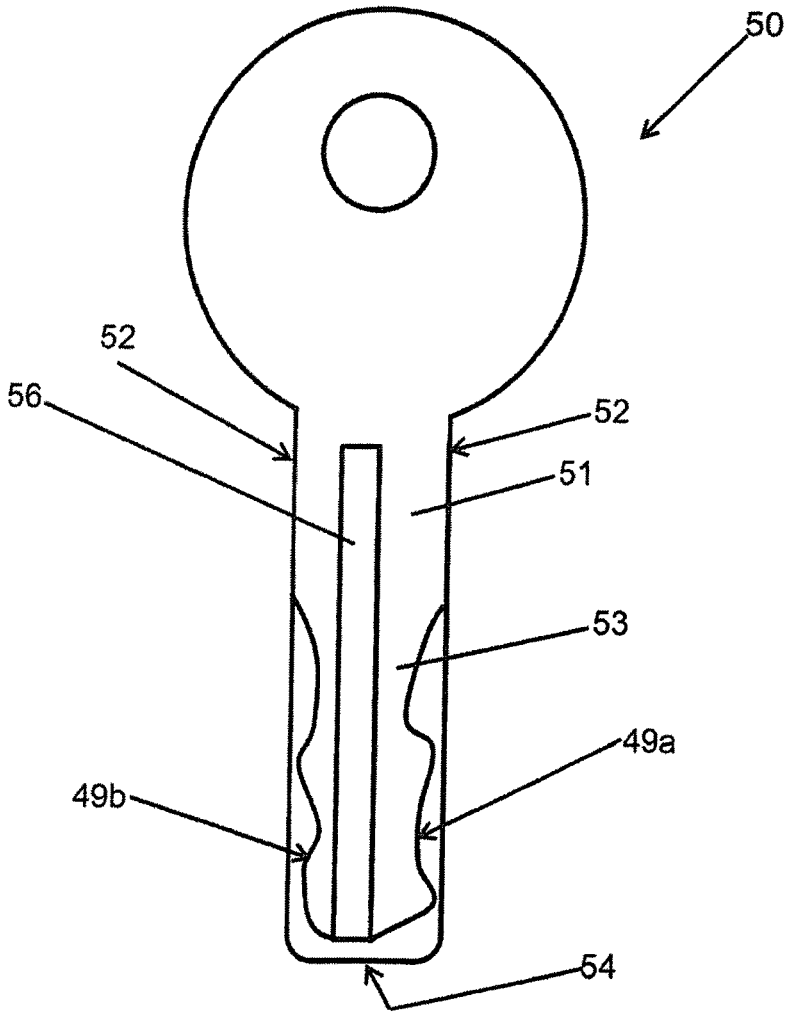
FIG. 9 is a schematic, broadside view of a reversible key for the cylinder lock embodying the principles of the present invention.
Figure 10:
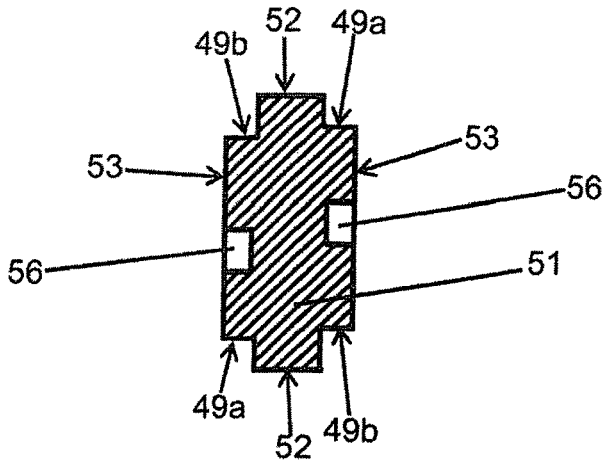
FIG. 10 is a schematic cross section view of a key bit of the key seen in FIG. 9.

The control and counter bearing edge 20 and the spring support edge 21 are preferably parallel to one another and extend perpendicular to the cylinder axis 3 and perpendicular to the plate sliding direction 13. Furthermore, the control and counter bearing edge 20 faces the second strip blocking end 16*b* and spring support edge 21 faces the first strip blocking end 16*a*. The lug end-edge 22 is parallel to the plate sliding direction 13, or parallel to the two strip sliding edges 17*a*; 17*b*, respectively. The control and counter bearing edge 20 interacts with, among other things, corresponding control tracks 49*a*; 49*b* of the key 50 fitting to the cylinder lock according to the invention (FIGS. 9, 10). As a result, the control and counter bearing lugs 19, in particular the control and counter bearing edges 20, are offset in relation to the individual plate tumblers 5*a*; 5*b* of the lock cylinder 1 in the plate sliding direction 13 (see FIG. 8). This means that in their non-locking position, the control and counter bearing edges 20 of the individual plate tumblers 5*a*; 5*b* of the lock cylinder 1 all have a different spacing to the transverse central plane 7, or the control and counter bearing edges 20 of the individual plate tumblers 5*a*; 5*b* of the lock cylinder 1 all have a different spacing A to the second strip blocking end 16*b*, seen in the plate sliding direction 13, respectively.

The cylinder core 4 (FIGS. 1-7) has an insertion end 4*a* as well as an actuation end 4*b*, lying opposite the insertion end in the direction of the cylinder axis 3. Furthermore, the cylinder core 4 has a key insertion bushing 23 in the known manner, a circular cylindrical guide element 24 and at least one, preferably two, driving pins 25 for actuating a lock mechanism for unlocking the cylinder lock, and a key channel 26. The key insertion bushing 23 is disposed at the insertion end 4*a*. The two driving pins 25 are disposed at the actuation end 4*a*. They are disposed eccentrically in relation to the cylinder axis 3, and protrude away from the guide element 24 toward the cylinder axis 3.

The circular cylindrical guide element 24 serves for rotatably bearing the cylinder core 4 in the cylinder housing 2 about the cylinder axis 3. Furthermore, the guide element 24 has a circular cylindrical guide element outer surface 27, the diameter of which corresponds to the diameter of the core receiving cut-out 9 of the cylinder housing 2. In the assembled state of the lock cylinder 1, the cylinder housing 2 is disposed around the cylinder core 4, wherein the guide element outer surface 27 rests against the core receiving cut-out 9 such that it can slide thereon.

The key channel 26 serves in the known manner to receive and guide a key. It extends parallel to the cylinder axis 3 and from the insertion end 4*a* into the cylinder core 4. The key channel 26 extends thereby through the insertion bushing 23 into the guide element 24. Furthermore, the guide element 24 preferably has centering strips 42, known per se (FIG. 6), which extend into the key channel 26. The centering strips 42 extend parallel to the cylinder axis 3. There is a centering strip 42 on each side of the longitudinal central plane 6. The two centering strips 42 are preferably offset to one another in the plate sliding direction 13.

The guide element 24 is designed in two pieces, for manufacturing reasons, and has a base body 28 and an insertion component 29 inserted into the base body 28, which shall be explained in greater detail below. In the following, the guide element 24 shall first be described as a whole:

In order to receive the plate tumblers 5*a*; 5*b*, the guide element 24 has numerous guide slots 30, which extend in the direction of the plate sliding direction 13 through the guide element 24. The guide slots 20 are disposed adjacent and flush to one another in the axial direction. Furthermore, all guide slots 30 are disposed adjacent to the key channel 26. Or rather all of the guide slots 30 are disposed on the same side in relation to the longitudinal central plane 6. They are thus all disposed on only one side of the longitudinal central plane 6. There are no guide slots 30 on the other side. The guide slots 30 have a height thereby, thus an extension in the direction of the cylinder axis 2, that corresponds to a plate thickness d (FIG. 2) of two plate tumblers 5*a*; 5*b*. As a result, two plate tumblers 5*a*; 5*b* can be disposed above one another in a guide slot 30. The guide slots 30 have two slot guide surfaces 31*a*; 31*b*, which extend parallel to the plate sliding direction 13, or parallel to the longitudinal central plane 6, respectively. Furthermore, the slot guide surfaces 31*a*; 31*b* are spaced apart from one another in a direction that is perpendicular to the plate sliding direction 13 and the cylinder axis 3, or to the longitudinal central plane 6. The spacing of the two slot guide surfaces 31*a*; 31*b* to one another corresponds thereby to the spacing of the two strip sliding edges 17*a*; 17*b* to one another.

As has already been explained, the guide slots 30 each extend through the guide element 24 in the direction of the plate sliding direction 13. The guide slots 30 thus have a first and second, in each case open, slot end 30*a*; 30*b*. In its non-actuated, or blocked, or locked, initial position, the guide element 24 is disposed thereby such that the guide slots 30 are disposed such that they are flush in the plate sliding direction 13 to the two opposing blocking grooves 10*a*; 10*b*, which are opposite to one another in the plate sliding direction 13.

The guide slots 30 also have a slot widening 32*a*; 32*b* at each of their slot ends 30*a*; 30*b*. The guide slot 30 widens, in each case, in the region of the slot widenings 32*a*; 32*b*, toward the cylinder axis 3, or toward the longitudinal central plane 6. The slot widenings 32*a*; 32*b* each open into the key channel 26. Furthermore, the slot widenings 32*a*; 32*b* each extend, seen from the respective slot end 30*a*; 30*b*, into the guide element 24. They are thus open at the respective slot end 30*a*; 30*b* toward the cylinder housing 2. The slot widenings 32*a*; 32*b* are delimited toward the interior in the plate sliding direction 13 by means of a counter bearing surface 33. The counter bearing surface 33 adjoins the slot guide surface 31*a* facing the cylinder axis 3, protrudes away therefrom, and is preferably perpendicular thereto. Furthermore, the counter bearing surface 33 extends to the key channel 26, but does not extend into it. The slot widenings 32*a*; 32*b* are laterally delimited by a widening guide surface 34, which extends parallel to the slot guide surfaces 31*a*; 31*b*. The widening guide surface 34 is offset to the cylinder axis 3, or to the longitudinal central plane 6, respectively, in relation to the two slot guide surfaces 31*a*; 31*b*.

The two slot widenings 32*a*; 32*b* of a guide slot 30 each have only one half of the height of the remaining guide slot 30 thereby. This means that the slot widenings 32*a*; 32*b* only extend over one half of the height of the guide slot 30, or the height of the two slot widenings 32*a*; 32*b* corresponds in each case to the plate thickness d of a plate tumbler 5*a*; 5*b*. The two slot widenings 32*a*; 32*b* of a guide slot 30 are disposed offset to one another in the direction of the cylinder axis 3, to the amount of a plate thickness d. Or rather the two slot widenings 32*a*; 32*b* of a guide slot 30 are disposed such that they are not flush to one another in the direction of the plate sliding direction 13. As a result, two plate tumblers 5*a*; 5*b* can be rotated 180° to one another and disposed above one another in the same guide slot 30.

The plate tumblers 5*a*; 5*b* are disposed in the guide slots 30 such that they can be displaced back and forth in the plate sliding direction 13. The two plate tumblers 5*a*; 5*b* disposed in the same guide slot 30 lie thereby with their plate surfaces 14*a*; 14*b* against one another such that they can slide. Due to the twisted arrangement to one another, the second plate surface 14*b* of the first plate tumbler 5*a* rests against the first plate surface 14*a* of the second plate tumbler 5*b*. The plate surfaces 14*a*; 14*b* are perpendicular to the cylinder axis 3 thereby.

Furthermore, the two strip sliding edges 17*a*; 17*b* lie in pairs against the two slot guide surfaces 31*a*; 31*b* such that they can slide. The first strip sliding edges 17*a* of the two plate tumblers 5*a*; 5*b* disposed in the same guide slot 30 are coplanar in relation to one another, and the second strip sliding edges 17*b* of the two plate tumblers 5*a*; 5*b* disposed in the same guide slot 30 are likewise coplanar in relation to one another.

The control and counter bearing lugs 19 of all of the plate tumblers 5*a*; 5*b* each face toward the cylinder axis 3, or the longitudinal central plane 6, respectively, thereby, wherein the control and counter bearing lugs 19 of the two plate tumblers 5*a*; 5*b* disposed in the same guide slot 30 are each disposed on the other side of the transverse central plane 7. Or rather the control and counter bearing lugs 19 of the two plate tumblers 5*a*; 5*b* disposed in the same guide slot 30 are disposed opposite one another in the plate sliding direction 13. The two plate tumblers 5*a*; 5*b* disposed in the same guide slot 30 are thus disposed such that they are rotated 180° in relation to one another about a rotational axis that is perpendicular to the longitudinal central plane 6.

The control and counter bearing lugs 19 are each disposed in one of the two slot widenings 32*a*; 32*b* thereby. The lug end-edges 22 each rest thereby against the widening guide surface 34 such that they can slide thereon. Because the extension of the widening guide surface 34 corresponds to the thickness d of the plate in the axial direction, the lug end-edges 22 lie with their entire surface, or entirely, on the widening guide surface 34 in the axial direction.

In their locking initial position, the guide and blocking strips 16 also extend with their second strip blocking ends 16*b*, in each case, into one of the blocking grooves 10, such that the cylinder core 4 is connected in a non-rotatable manner about the cylinder axis 3 to the cylinder housing 2. The two plate tumblers 5*a*; 5*b* disposed in the same guide slot 30 extend thereby into the opposing blocking grooves 10*a*; 10*b*. This means that the first plate tumbler 5*a* extends into the first blocking groove 10*a* and the second plate tumbler 5*b* extends into the second blocking groove 10*b*.

In their locking initial position, the control and counter bearing lugs 19 also lie, in each case, with their control and counter bearing edges 20 against the counter bearing surface 33 of the guide element 24. The control and counter bearing edge 20 extends thereby beyond the counter bearing surface 33 toward the cylinder axis 3. It extends into the key channel 26. The control and counter bearing lugs 19, in particular the control and counter bearing edges 20 thus extend into the key channel 26 in regions, in particular with the portion extending over the counter bearing surface 33. As a result, the control and counter bearing edges 20 slide along the control tracks 49*a*; 49B of the key 50 when it is inserted into the key channel 26, as shall be explained in greater detail below. The control and counter bearing edges 20 of the two plate tumblers 5*a*; 5*b* disposed in the same guide slot 30 lie opposite one another in the plate sliding direction 13, or face one another, respectively.

According to the invention, the two plate tumblers 5*a*; 5*b* disposed in the same guide slot 30 are connected to the same torsion spring, or leg spring, so as to be driven in their locking position. The two plate tumblers 5*a*; 5*b* disposed in the same guide slot 30 are driven thereby in opposing plate blocking directions 43*a*; 43*b*, or in opposing directions, respectively.

The leg spring 35 has a central winding 36 made of spring wire 37, wherein the two ends of the spring wire 37 form spring legs 38*a*; 38*b* in each case with a free leg end 55 that extends away from the winding 36. A spring axis 35*a* is parallel to the cylinder axis 6, but spaced apart therefrom. The spring legs 38*a*; 38*b* each have a first leg section 39 and a second leg section 40 thereby. The first leg section 39 adjoins, in each case, the winding 36, wherein the two first leg sections 39 extend in opposing directions. The first leg sections 39 each transition into the second leg sections 40 in a curved section, or at a dogleg 41. The two second leg sections 40 extend thereby in substantially the same direction. The leg spring 35 thus has a U-shape. The free leg end 55 is preferably bent in each case toward the spring axis 35*a* in relation to the respective second leg section 40, wherein the two leg ends 55 extend in opposite directions in relation to the direction of the spring axis 35*a*.

For the bearing of the leg spring 35, the guide element 24 has a spring receiving groove 44 in each case, which extends in the circumferential direction, and extends from the guide element 27 outer surface 27 into the guide element. The spring receiving groove 44 has a central groove section 45 for receiving the winding 36, and two adjoining leg receiving sections 46*a*; 46*b* for receiving the two spring legs 38*a*; 38*b*. Preferably the two leg receiving sections 46*a*; 46*b* are offset to one another in the axial direction, corresponding to the arrangement of the two spring legs 38*a*; 38*b*. Groove floor surfaces 47 of the leg receiving sections 46*a*; 46*b* form bearing surfaces for the spring legs 38*a*; 38*b*. The two leg receiving sections 46*a*; 46*b* each open into one of the two slot widenings 32*a*; 32*b*. The respective slot widening 32*a*; 32*b* is axially offset with respect to the leg receiving section 46*a*; 46*b*, into which it opens.

Preferably the guide element 24 is also recessed, likewise in the radial direction, adjacent to the respective leg receiving section 46*a*; 46*b* in the axial direction. In particular, the guide element 24 has, in each case, a spring insertion surface 57*a*; 57*b* adjacent to the respective leg receiving section 46*a*; 46*b* in the axial direction. The first and second spring insertion surfaces 57*a*; 57*b* are offset to one another in the axial direction. In a manner analogous to the leg receiving section 46*a*; 46*b*, the first spring insertion surface 57*a* is disposed on the one side of the transverse central plane 7 and the other spring insertion surface 57*b* is disposed on the other side of the transverse central plane. Furthermore, the two spring insertion surfaces 57*a*; 57*b* each extend toward the longitudinal central plane 6, seen from the central groove section 45, wherein the spacing to the transverse central plane 7 decreases. As a result, the two spring insertion surfaces 57*a*; 57*b* collectively form an insertion ramp, or an insertion wedge for the installation of the leg springs 35.

A leg spring 35 in each case is disposed in one of the spring receiving grooves 44, such that the winding 36 is disposed inside the central groove section 45. The two spring legs 38*a*; 38*b* are each disposed in one of the two leg receiving sections 46*a*; 46*b*. The free ends 55 of the legs extend into the respective slot widenings 32*a*; 32*b* thereby, and lie against the spring bearing edges 21 of the control and counter bearing lugs 19 of the plate tumblers 5*a*; 5*b* disposed in the slot widenings 32*a*; 32*b*. This means that the first spring leg 38*a* abuts the control and counter bearing lug 19 of the first plate tumbler 5*a*, and the second spring leg 38*b* abuts the control and counter bearing lug 19 of the second plate tumbler 5*b*, wherein the two plate tumblers 5*a*; 5*b* are disposed in the same guide slot 30.

Furthermore, the leg spring 35 is hooked into the slot widening 32*a*; 32*b* by means of the free ends 55 of the leg. The spring legs 38*a*; 38*b* are bent up, or spread out, respectively, in comparison to the relaxed position of the leg spring 35. The leg spring 35 is thus tensioned. The spring legs 38*a*; 38*b* press the control and counter bearing lugs 19 of the two plate tumblers 5*a*; 5*b* disposed in the same guide slot 30 toward one another because of this. The plate tumblers 5*a*; 5*b* are thus driven in opposing directions by means of the leg spring 35, in each case into their locking position.

As has already been explained, the guide element 24 is preferably designed in two parts for manufacturing reasons, and is composed of the base body 28 and the insert part 29. The insert part 29 is designed as an oblong block, extending in the axial direction. It is inserted in a direction perpendicular to the transverse central plane 7 into the base body 28. In the inserted state, it borders on the key channel 26 as well as the first slot widening at one side, and forms a portion of the guide element outer surface 27 as well as the spring receiving grooves 44, among other things. It is retained, preferably, by the leg springs 35, in that these encompass the insertion part 29 with the first spring legs 38*a*. The insertion part 29 can also be press-fitted, or permanently connected to the base body 28 by some other means.

During assembly, the insert part 29 is first placed in the base body 28. The plate tumblers 5*a*; 5*b* are then inserted into the guide slots 30, and subsequently, the leg springs 35 are installed. Thereby the two spring legs 38*a*; 38*b* are guided via the leg ends 55 along the spring insertion surfaces 57*a*; 57*b* and spread apart. The spring legs 38*a*; 38*b* then snap downward from the spring insertion surfaces 57*a*; 57*b* into the spring receiving grove 44.

The lock cylinder 1 preferably also has a mounting tumbler 48, known per se, which serves as for axial securing of the cylinder core 4 in the known manner.

In the following, the functionality of the lock cylinder 1 according to the invention shall be explained in greater detail:

As has already been explained, the plate tumblers 5*a*; 5*b* are located in their locking starting position, as long as a correct key 50 has not been inserted in the lock cylinder 1. In this position, the two strip blocking ends 16*b* engage with the two blocking grooves 10*a*; 10*b*, such that the cylinder core 4 is connected to the cylinder housing 2, such that it cannot rotate about the cylinder axis 3.

The key 50 for the cylinder lock according to the invention is preferably designed as a reversible key, and has a key bit 51 having two narrow edges 52 and two wide lateral surfaces 53, and an free end edge 54. The key bit 51 has, in each case, two outwardly protruding control tracks 49*a*; 49*b* on the two wide lateral surfaces 53, which are preferably formed by milling. The control tracks 49*a*; 49*b*, which lie diagonally opposite one another, are identical thereby. Furthermore, the key bit 51 has two centering grooves 56, each of which is disposed on one of the wide lateral surfaces and extends along the key bit 51 between the two control tracks 49*a*; 49*b*.

If the key 50 is inserted in the key channel 26, then, on one hand, the two centering strips 42 slide in the known manner within the centering grooves 56, such that the key 50 is centered in the key channel 26. Moreover, the plate tumblers 5*a*; 5*b*, via the region of the control and counter bearing edges 20 extending into the key channel 26, slide along the two control tracks 49*a*; 49*b* of the key 50, which are disposed on the same wide lateral surfaces 53 of the key 50. All of the first plate tumblers 5*a* slide along the first control track 49*a*, and all of the second plate tumblers 5*b* slide along the second control track 49*b* thereby.

By inserting the appropriate key 50, the plate tumblers 5*a*; 5*b* are then displaced against the force of the leg spring 35 counter to their respective plate blocking direction 43*a*; 43*b*. They are thus moved in opposite directions. The plate tumblers 5*a*; 5*b* are moved into the cylinder core 4 thereby, until they no longer engage in the blocking grooves 10*a*; 10*b*. The cylinder core 4 can then be rotated, and the cylinder lock is unlocked, or unblocked, respectively, by means of the driving pins 25 through the actuation of the lock mechanism. If an incorrect key 50 is inserted, the plate tumblers 5*a*; 5*b* are either not pulled far enough back, such that they still extend into the respective blocking groove 10*a*; 10*b* with their second strip blocking ends, or they are pulled too far back, such that they then engage in the opposite blocking groove 10*a*; 10*b* with their first strip blocking end 16*a*.

In the non-locking position of the plate tumblers 5*a*; 5*b*, the counter bearing lugs 19 and in particular the spring bearing edges 21 of the plate tumblers 5*a*; 5*b* located in the same guide slot 30 are further apart than in the locking position. As a result, the spring legs 38*a*; 38*b* are spread further apart than when they are in the locking position. Because of this, the plate tumblers 5*a*; 5*b* automatically sweep back into their locking starting position, after the cylinder core 4 has been rotated back, and the key 50 has been removed, driven by the force of the leg spring 35.

The advantage of the lock cylinder 1 according to the invention is that, on one hand, a large number of key combinations can be used.

Furthermore, the strip-shaped plate tumblers 5*a*; 5*b* are very stable, and do not become deformed, even with high torques. This is because, among other things, the plate tumblers 5*a*; 5*b* are not do not support themselves via the counter bearing lugs facing away from the longitudinal central plane 6. The positions for applying force via the cylinder housing 2 and the bearing in the cylinder core 4 during the torsional stress are very close together. The introduction of force occurs at the one strip sliding edge 17*a*; 17*b* and the bearing occurs at the other strip sliding edge 17*a*; 17*b*. Furthermore, the plate tumblers 5*a*; 5*b* are each supported over their entire plate thickness d, both in the cylinder housing 2 as well as in the cylinder core 4.

Because the strip-shaped plate tumblers 5*a*; 5*b* do not have a key receiving groove, as is the case with known plate tumblers, the plate tumblers 5*a*; 5*b* are more robust. This is because the key receiving groove causes a notching effect, which compromises the stability. With the strip-shaped plate tumblers 5*a*; 5*b*, the second strip sliding edge 17*b* is designed to be continuous, or without notches, from the first to the second strip blocking end 16*a*; 16*b*. And the first strip sliding edge 17*a* is likewise designed to be continuous, or without notches, from the control and counter bearing lug 19 to the second strip blocking end 16*b*.

Furthermore, it has become possible, due to the leg spring 35, to decrease the diameter of the lock cylinder 1. This is because the known, radially outward disposed compression springs require more space in the radial direction than the leg springs 35 according to the invention.

Moreover, the compression springs also require more space in the axial direction, such that the axial structural length of the lock cylinder 1 according to the invention could also be decreased.

Furthermore, there is greater security against break-ins with the lock cylinder 1 according to the invention. This is because, when one looks into the key channel 26 from the outside, one cannot see which plate tumblers 5*a*; 5*b* are used for the cylinder lock with regard to the configuration of the control and counter bearing edges 20. The plate tumblers 5*a*; 5*b* all bear against the counter bearing surfaces 33 with their control and counter bearing lugs 19 in the same manner. The counter bearing surfaces 33 and thus the control and counter bearing edges 20 of all the plate tumblers 5*a*; 5*b* thus all have the same spacing to the transverse central plane 7. Or rather they are disposed axially such that they are flush to one another. With the prior art, on the contrary, it can be seen from the exterior that the control steps of the individual plate tumblers are disposed at different positions.

The break-in security is furthermore also increased in that the two plate tumblers 5*a*; 5*b* are driven in opposite directions with the same leg spring 35. If it is then attempted by means of a tool to move the one plate tumbler 5*a* into its non-locking position, the leg spring 35 becomes more tensioned, and the second plate tumbler 5*b* is then pushed with greater force into its locking position.

It is also within the scope of the invention that the plate tumblers 5*a*; 5*b* are each disposed in their own guide slot. In accordance with the invention, two axially adjacent plate tumblers 5*a*; 5*b*, driven with the same leg spring 35, are then connected to one another.

Furthermore, it is not absolutely necessary to use leg springs 35 designed as helical springs, even though this is preferred. It is essential to the invention that this spring is a, preferably U-shaped, spring clamp, or clamp spring, respectively, which includes the two spring legs 38*a*; 38*b*, of which the one spring leg 38*a* is supported on the first plate tumbler 5*a*, and the other spring leg 38*b* is supported on the second plate tumbler 5*b*. By way of example, the spring clamp can also be a U-shaped spring clip, e.g. made of spring wire or sheet metal. The spring clamps, in particular the leg spring 35, can be made of metal or plastic in general.

The invention claimed is:

1. A lock cylinder for a cylinder lock, in particular for motor vehicles for construction and agriculture machines, comprising:

a cylinder axis as well as a longitudinal central plane containing the cylinder axis and a transverse central plane perpendicular thereto, likewise containing the cylinder axis, a cylinder housing having an axial core receiving cut-out and at least two axially extending blocking grooves that are open to the core receiving cut-out, a cylinder core supported inside the core receiving cut-out, having an axial key channel and a plurality of guide slots extending through the cylinder core in a plate-sliding direction perpendicular to the transverse central plane, a plurality of strip-shaped plate tumblers, the plate tumblers each having a guide and blocking strip, a single control and counter bearing lug protruding from the guide and blocking strip toward the longitudinal central plane and located adjacent one end of the guide and blocking strip, the plate tumblers being supported in one of the guide slots such that they can be displaced back and forth in the plate sliding direction, wherein the plate tumblers each have a locking position, in which they each engage with one of the blocking grooves such that the cylinder core is connected to the cylinder housing in a non-rotating manner about the cylinder axis, and having a non-locking position, in which they are driven into the cylinder core far enough that they do not engage in the blocking grooves and the cylinder core can rotate about the cylinder axis in the cylinder housing, a plurality of spring clamps biasing the plate tumblers in a plate blocking direction and into their locking position, wherein, in each case, two of the plate tumblers are connected to a single spring clamp of the plurality of spring clamps and biased in opposite directions into their respective locking positions and are disposed adjacent to one another in the axial direction in the same guide slot, the two plate tumblers disposed in the same guide slot lie with plate surfaces against one another such that they can slide.

2. The lock cylinder according to claim 1, wherein the plate tumblers and the guide slots are all disposed on the same side of the longitudinal central plane.

3. The lock cylinder according to claim 1, wherein the spring clamps are each disposed in a spring receiving groove of the cylinder core that extends in a circumferential direction of the cylinder core and extends from the outside into the cylinder core.

4. The lock cylinder according to claim 1, wherein the two blocking grooves, in which the plate tumblers engage when in their locking position, lie opposite one another in the plate sliding direction.

5. The lock cylinder according to claim 1, wherein the plate tumblers each have a longitudinal guide and blocking strip, having a longitudinal extension parallel to the plate sliding direction, as well as a first strip blocking end and a second strip blocking end, wherein, in the locking position, the guide and blocking strip engages one of the blocking grooves with the second strip blocking end.

6. The lock cylinder according to claim 5, wherein the guide and blocking strip has a first strip sliding edge, a second strip sliding edge and two strip end edges, wherein the first and second strip sliding edges extend parallel to the plate sliding direction and the plate tumblers are guided in a sliding manner, in each case via the first and second strip sliding edges, within the guide slot.

7. The lock cylinder according to claim 1, wherein the control and counter bearing lugs each have a control and counter bearing edge facing the second strip blocking end for guiding the plate tumbler along a control track of a correct key for the cylinder lock, a spring bearing edge facing the first strip blocking end, and a lug end edge facing the longitudinal central plane.

8. The lock cylinder according to claim 7, wherein the control and counter bearing edges of each of the plate tumblers of the lock cylinder have a different spacing to the second strip blocking end when viewed in the plate sliding direction.

9. The lock cylinder according to claim 1, wherein the cylinder core has at least one centering strip for interacting with a corresponding centering groove of the corresponding key in each case, which extend into the key channel and extend parallel to the cylinder axis.

10. The lock cylinder according to claim 1, wherein the guide slots are disposed such that they are adjacent to one another and flush to one another in the axial direction.

11. The lock cylinder according to claim 1, wherein the guide slots each have two slot guidance surfaces, which extend parallel to the plate sliding direction, and are spaced apart from one another in a direction perpendicular to the longitudinal central plane, wherein the two strip sliding edges are guided in pairs in a sliding manner on the slot guidance surfaces in the plate sliding direction.

12. The lock cylinder according to claim 1, wherein the guide slots have a first and a second slot end, open in each case toward the cylinder housing, wherein the cylinder core, in its locked position, is disposed such that the guide slots are disposed, in the plate sliding direction, flush with the blocking grooves that are opposite one another in the plate sliding direction.

13. The lock cylinder according to claim 12, wherein each of the guide slots have a slot widening at the first and second slot ends, wherein the guide slot in the region of the slot widenings widens in each case toward the longitudinal central plane, and the slot widenings each open into the key channel.

14. The lock cylinder according to claim 13, wherein the slot widenings are delimited in the plate sliding direction by a counter bearing surface, which adjoins the slot guidance surface facing the longitudinal central plane and extends away therefrom, wherein the counter bearing surface extends to the key channel, and the slot widenings are laterally delimited by a widening guidance surface, which extends parallel to the slot guidance surfaces, wherein the widening guidance surface is offset with respect to the two slot guidance surfaces toward the longitudinal central plane.

15. The lock cylinder according to claim 13, wherein the axial thickness of each of the slot widenings of the guide slots each correspond to a plate thickness of a plate tumbler, wherein the two slot widenings of a guide slot are disposed offset to one another in the axial direction by the amount of the thickness of a plate.

16. The lock cylinder according to claim 11, wherein each of the plate tumblers disposed in the same guide slot rest against one another with their plate upper surfaces such that they can slide, and the strip sliding edges rest against the slot guidance surfaces in pairs such that they can slide, wherein the first strip sliding edges of each of the plate tumblers disposed in the same guide slot are coplanar to one another, and the second strip sliding edges of each of the plate tumblers are coplanar to one another.

17. The lock cylinder according to claim 1, wherein the control and counter bearing lugs of each of the plate tumblers disposed in the same guide slot are each disposed on the other side of the transverse central plane, wherein each of the plate tumblers are disposed such that they are rotated 180° in relation to one another about a rotational axis that is perpendicular to the longitudinal central plane.

18. The lock cylinder according to claim 14, wherein the control and counter bearing lugs are each disposed in one of the slot widenings, wherein the lug end edges rest in a sliding manner on the respective widening guidance surface, wherein the lug end edges rest entirely in the axial direction on the widening guidance surface.

19. The lock cylinder according to claim 14, wherein the control and counter bearing lugs each rest with their control and counter bearing edge against the counter bearing surface of the cylinder core when the plate tumblers are in the locking position, wherein the control and counter bearing edges each extend beyond the counter bearing surface toward the longitudinal central plane.

20. The lock cylinder according to claim 14, wherein the control and counter bearing edges extend into the key channel in part with their region extending beyond the counter bearing surface, wherein, the control and counter bearing edges of each of the plate tumblers disposed in the same guide slot are opposite one another in the plate sliding direction.

21. The lock cylinder according to claim 7, wherein, when the plate tumblers are in the locking position, the control and counter bearing edges of the respective plate tumblers, which are driven in the same plate locking direction, are disposed such that they are flush to one another in the axial direction.

22. The lock cylinder according to claim 7, wherein, when the plate tumblers are in the locking position, the control and counter bearing edges of all of the plate tumblers all have the same spacing to the transverse central plane.

23. The lock cylinder according to claim 1, wherein each of the spring clamps has two spring legs and each spring leg has a free leg end, one of the spring legs with its free leg end bearing against the first plate tumbler and the other of the spring legs with its free leg end bearing against the second plate tumbler.

24. The lock cylinder according to claim 23, wherein the spring clamp has a central winding made of spring wire, and two ends of the spring wire each form the spring legs in each case having the free leg ends and protruding away from the winding, wherein, the free leg ends are each bent in the direction of a spring axis with respect to the rest of the spring leg, wherein the leg ends extend in opposite directions with respect to the direction of the spring axis.

25. The lock cylinder according to claim 23, wherein a first spring leg of the two spring legs, with the leg end, bears against the control and counter bearing lug and the spring bearing edge of one of the plate tumblers, and a second spring leg of the two spring legs, with the leg end, bears against the control and counter bearing lug and the spring bearing edge of other of the plate tumblers.

26. The lock cylinder according to claim 13, wherein the spring receiving grooves each open into the two slot widenings.

27. A cylinder lock, in particular for a motor vehicle for construction and agricultural machines, having a lock cylinder and a key fitting the lock cylinder, wherein the lock cylinder is constructed according to claim 1.

28. The cylinder lock according to claim 27, wherein the key has a key bit with two narrow edges and two wide lateral edges, and an free end edge, wherein the key bit has two control tracks protruding outward in each case on both wide lateral surfaces, and wherein the key bit has two centering grooves, each of which are disposed on one of the wide lateral surfaces, and extend along the key bit between the two control tracks.

* * * * *